US009144953B2

(12) United States Patent
Hayashi

(10) Patent No.: US 9,144,953 B2
(45) Date of Patent: Sep. 29, 2015

(54) FOLDED SHEET PRESSING DEVICE, SHEET PROCESSING APPARATUS, AND IMAGE FORMING APPARATUS

(75) Inventor: Kakeru Hayashi, Aichi (JP)

(73) Assignee: Ricoh Company, Limited, Tokyo (JP)

( * ) Notice: Subject to any disclaimer, the term of this patent is extended or adjusted under 35 U.S.C. 154(b) by 652 days.

(21) Appl. No.: 13/330,123

(22) Filed: Dec. 19, 2011

(65) Prior Publication Data

US 2012/0165175 A1 Jun. 28, 2012

(30) Foreign Application Priority Data

Dec. 22, 2010 (JP) ..... 2010-286153

(51) Int. Cl.

| | |
|---|---|
| ***B65H 45/14*** | (2006.01) |
| ***B65H 45/12*** | (2006.01) |
| ***B41L 43/00*** | (2006.01) |
| ***B65H 39/00*** | (2006.01) |
| ***B65H 45/04*** | (2006.01) |
| ***B31F 1/00*** | (2006.01) |
| ***B65H 29/70*** | (2006.01) |

(52) U.S. Cl.
CPC ..... *B31F 1/0025* (2013.01); *B65H 29/70* (2013.01); *B65H 2801/27* (2013.01)

(58) Field of Classification Search
CPC ..... B65H 2511/224; B65H 2404/14; B65H 45/04; B65H 45/12; B65H 45/14; B65H 39/02
USPC ..... 493/465, 360, 438, 446, 405, 406, 419, 493/420, 455, 456, 459, 460
See application file for complete search history.

(56) References Cited

U.S. PATENT DOCUMENTS

| | | | | |
|---|---|---|---|---|
| 4,591,259 | A * | 5/1986 | Kuo et al. | 399/406 |
| 5,190,514 | A * | 3/1993 | Galvanauskas | 493/420 |
| 5,377,965 | A * | 1/1995 | Mandel et al. | 270/37 |
| 5,437,596 | A * | 8/1995 | Bogdan et al. | 493/420 |
| 5,539,511 | A * | 7/1996 | Wenthe et al. | 399/361 |
| 8,328,707 | B2 * | 12/2012 | Pressman et al. | 493/424 |
| 8,721,207 | B2 * | 5/2014 | Sekino et al. | 400/621 |
| 2010/0284720 | A1 * | 11/2010 | Hayashi | 399/407 |
| 2011/0160027 | A1 * | 6/2011 | Pressman et al. | 493/25 |

FOREIGN PATENT DOCUMENTS

| | | | |
|---|---|---|---|
| JP | 3741679 | B2 | 4/2004 |
| JP | 2009-208849 | A | 9/2009 |

OTHER PUBLICATIONS

English language abstract for patent publication No. JP-2004-123245 which corresponds to JP-3741679-B2.

* cited by examiner

*Primary Examiner* — Thanh Truong
*Assistant Examiner* — Praachi M Pathak
(74) *Attorney, Agent, or Firm* — Harness, Dickey & Pierce, P.L.C.

(57) ABSTRACT

A folded sheet pressing device including: a folded sheet pressing unit configured to enhance a folded edge of a sheet subjected to a folding process; and a curving unit configured to curve the sheet in a sheet conveying direction when the sheet is supplied to the folded sheet pressing unit.

15 Claims, 6 Drawing Sheets

Z-FOLDING

TWO-FACE FOLDING

OUTWARD THREE-FACE FOLDING

INWARD THREE-FACE FOLDING

SIMPLE FOUR-FACE FOLDING

SIDE-BY-SIDE FOUR-FACE FOLDING

FOLDED SHEET PRESSING DEVICE, SHEET PROCESSING APPARATUS, AND IMAGE FORMING APPARATUS

CROSS-REFERENCE TO RELATED APPLICATIONS

The present application claims priority to and incorporates by reference the entire contents of Japanese Patent Application No. 2010-286153 filed in Japan on Dec. 22, 2010.

BACKGROUND OF THE INVENTION

1. Field of the Invention

The present invention relates to a folded sheet pressing device which enhances a folded edge of a sheet subjected to a folding process, and a sheet processing apparatus and an image forming apparatus which include the folded sheet pressing device.

2. Description of the Related Art

In image forming apparatuses such as copying machines, printers, facsimiles, or multi-function peripherals, an image forming apparatus has been provided which includes a sheet folding device capable of performing, for example, Z-folding, two-face folding, inward three-face folding, outward three-face folding, simple four-face folding, and side-by-side four-face folding on a sheet such as a sheet having an image formed thereon. Further, as such a sheet folding device, there is known a sheet folding device which includes a folded sheet pressing device configured to enhance the folded edge of the sheet folded by a folding member.

Although a pressure is applied to the sheet when the folded edge of the sheet is enhanced by the folded sheet pressing device, if a flexure is present in the sheet at this time, the flexure is crushed by the pressure, so that it becomes a wrinkle. As a result, a problem arises in that the quality of the sheet subjected to the folding process is degraded.

Therefore, in the sheet folding device disclosed in, for example, Japanese Patent Application Laid-open No. 2009-208849, the sheet or the sheet bundle which has passed through the folding process is temporarily stopped to allow folded sheet pressing rollers to move thereon along the folded edge while pressing the sheet or the sheet bundle. This process prevents occurrence of an unnecessary flexure, and hence prevents generation of the wrinkles.

However, in the sheet folding device disclosed in Japanese Patent Application Laid-open No. 2009-208849, since the folded sheet pressing process is performed with a temporal halt of the sheet or the sheet bundle, a problem arises in that the folding productivity is degraded.

Therefore, there is a need of a folded sheet pressing device capable of performing the folded sheet pressing process without degrading the sheet folding productivity and generating the wrinkle in the sheet, and a sheet processing apparatus and an image forming apparatus which include the folded sheet pressing device.

SUMMARY OF THE INVENTION

It is an object of the present invention to at least partially solve the problems in the conventional technology.

A folded sheet pressing device including: a folded sheet pressing unit configured to enhance a folded edge of a sheet subjected to a folding process; and a curving unit configured to curve the sheet in a sheet conveying direction when the sheet is supplied to the folded sheet pressing unit.

A sheet processing apparatus including: a folded sheet pressing device including a folded sheet pressing unit configured to enhance a folded edge of a sheet subjected to a folding process; and a curving unit configured to curve the sheet in a sheet conveying direction when the sheet is supplied to the folded sheet pressing unit An image forming apparatus including: a sheet processing apparatus including a folded sheet pressing device, the folded sheet pressing device including a folded sheet pressing unit configured to enhance a folded edge of a sheet subjected to a folding process; and a curving unit configured to curve the sheet in a sheet conveying direction when the sheet is supplied to the folded sheet pressing unit The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
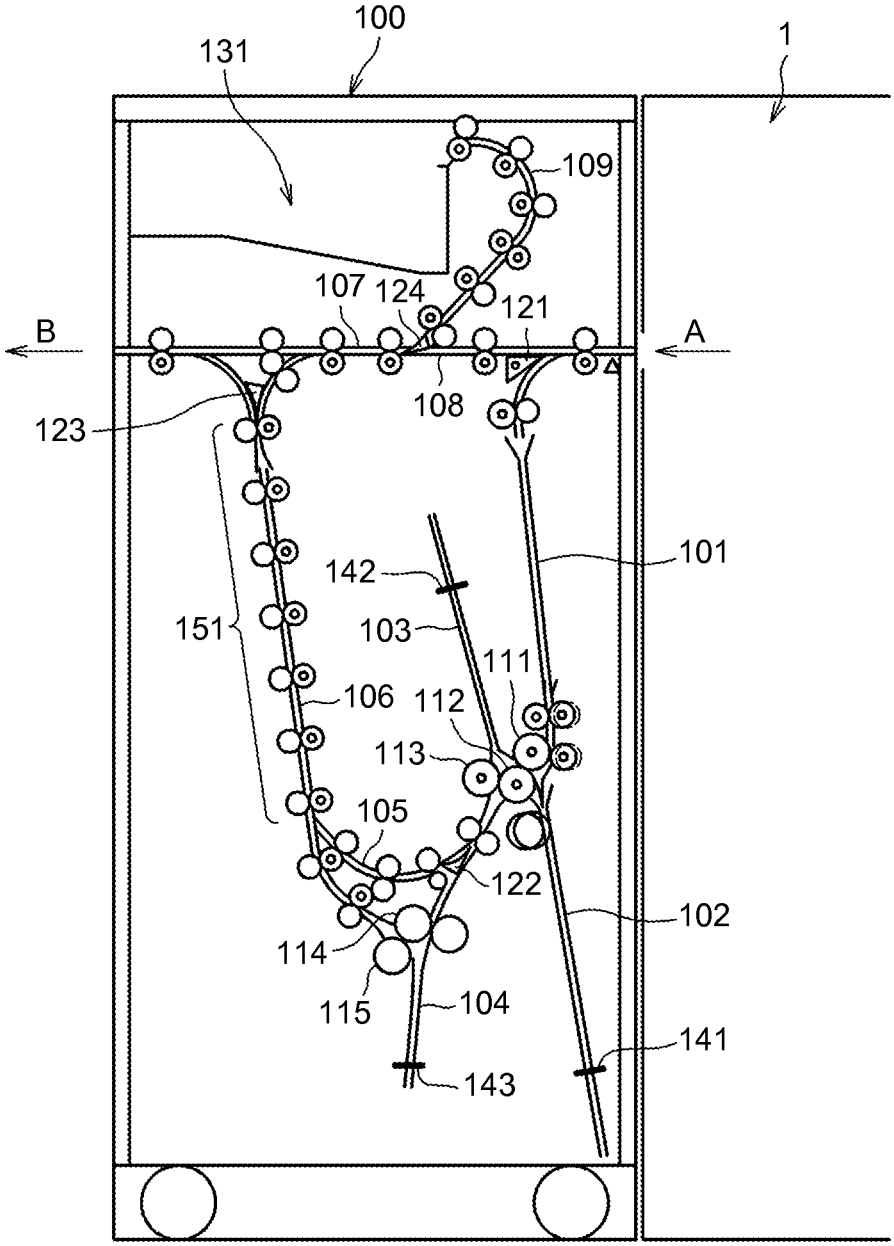
FIG. 1 is a configuration diagram illustrating an overall layout of a sheet processing apparatus which is an embodiment of the invention.

Hereinafter, embodiments of the invention will be described with reference to the accompanying drawings. Furthermore, in the respective drawings used for illustrating the embodiments, a component such as a member or a unit having the same function or shape will be described only once by giving the same distinguishable reference numeral thereto, and the description thereof will not be repeated.

FIG. 1 is a configuration diagram illustrating an overall layout of a sheet processing apparatus which is an embodiment of the invention. First, referring to FIG. 1, an overall configuration and an operation of the sheet processing apparatus according to the embodiment will be described.

In FIG. 1, reference numeral 1 indicates an image forming apparatus 1 which is an upper-level apparatus of the sheet discharging side, and reference numeral 100 indicates a sheet processing apparatus 100. In the drawing, the sheet which is discharged from the image forming apparatus 1 installed at the right side of the sheet processing apparatus 100 is introduced in the direction depicted by the arrow A. Regarding the configuration of the image forming apparatus 1, the image forming apparatus has a generally known configuration. That is, the image forming apparatus includes a sheet conveying path, an image forming unit which performs an image forming process on a sheet, and a discharging unit which discharges the sheet having an image formed thereon in the direction depicted by the arrow A.

In the sheet processing apparatus 100 illustrated in FIG. 1, reference numeral 101 to 109 indicate plural (in this example, nine) sheet conveying paths 101 to 109 which are provided for conveying the sheet and for performing various folding processes thereon, and sheet conveying paths 101 to 109 are respectively referred to as first to ninth conveying paths. Then, reference numeral 111 to 115 indicate plural (in this example, five) sheet folding rollers 111 to 115 which are provided for performing a sheet folding process at the arrangement portions, and the sheet folding rollers 111 to 115 are respectively referred to as first to fifth folding rollers.

Furthermore, reference numeral 121 to 124 indicate plural (in this example, four) conveying path switching members which are for switching conveying path and which are rotatably provided at branch portions of the conveying paths so as to switch the sheet conveying path, and are respectively referred to as first to fourth switching claws 121 to 124. Reference numeral 131 indicates a discharging unit 131 into which the sheet is discharged and which is provided at the upper portion of the apparatus; and reference numeral 141 to 143 indicate plural (in this example, three) stopper members 141 to 143 which are provided in the second conveying path 102, the third conveying path 103, and the fourth conveying path 104 so as to stop the movement of the sheet in the respective conveying paths and are respectively referred to as first to third stoppers. Further, reference numeral 151 indicates a folded sheet pressing device 151 which enhances a folded edge (crease) of the sheet subjected to the folding process.

With the embodiment of the above-described configuration, the respective folding operations, such as Z-folding, two-face folding, outward three-face folding, inward three-face folding, simple four-face folding, and side-by-side four-face folding may be performed.

In the case where the folding is not performed in the embodiment, the first switching claw 121 becomes a horizontal state, so that the sheet which is sent to the sheet processing apparatus 100 is discharged in the direction depicted by the arrow B from the sheet discharging port through the eighth conveying path 108 and the seventh conveying path 107 disposed at the left side of the drawing.

Further, in the case where the folding is performed, the first switching claw 121 guides the sheet to the respective conveying paths inside the folding device so as to perform various folding operations as below.

Z-Folding

The sheet is guided to the first conveying path 101 by the first switching claw 121. The sheet passes the nip between the first folding roller 111 and the second folding roller 112 by a guide member (not illustrated) which can protrude to and retract from the nip between the first folding roller 111 and the second folding roller 112 in the first conveying path 101, and the front end of the sheet comes into contact with the second stopper 142 which has moved to a predetermined folding position of the third conveying path 103.

Figure 13A:
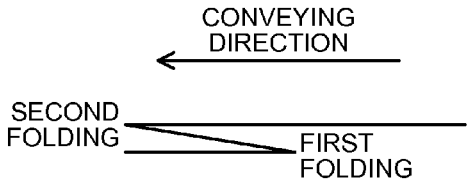
FIG. 13A is a diagram illustrating a Z-folding process of the embodiments.

After the front end of the sheet comes into contact with the second stopper 142, the flexure portion of the sheet advances to the nip between the second folding roller 112 and the third folding roller 113, so that first folding is performed. Subsequently, the sheet is conveyed to the fourth conveying path 104 by the second switching claw 122. The front end of the sheet comes into contact with the third stopper 143 which has moved to a predetermined folding position of the fourth conveying path 104. The flexure portion formed in the sheet is made to advance to the nip between the fourth folding roller 114 and the fifth folding roller 115, so that second folding is performed. In this way, the Z-folding is completed (FIG. 13A).

After the folding is completed, the sheet is conveyed to the sixth conveying path 106, and is subjected to a folded sheet pressing process by the folded sheet pressing device 151. Then, the sheet passes the sixth conveying path 106, and is guided to the seventh conveying path 107 by the third switching claw 123. Furthermore, the sheet is guided to the ninth conveying path 109 by the fourth switching claw 124 so as to be stacked on the discharging unit 131. In the case where the sheet is discharged to the outside of the apparatus, the sheet is discharged to the outside of the apparatus while the conveying direction thereof is switched by the third switching claw 123.

Two-Face Folding

Figure 13B:
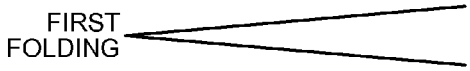
FIG. 13B is a diagram illustrating a two-face folding process of the embodiments.

The sheet is guided to the first conveying path 101 by the first switching claw 121. The front end of the sheet comes into contact with the first stopper 141 of the second conveying path 102. The flexure portion formed in the sheet is made to advance to the nip between the first folding roller 111 and the second folding roller 112 so as to be folded. In this way, two-face folding is completed (FIG. 13B).

The two-face folded sheet is guided to the fifth conveying path 105 by the second switching claw 122 while passing the nip between the second folding roller 112 and the third folding roller 113 without advancing to the third conveying path 103 by a guide member (not illustrated). Furthermore, the two-face folded sheet is conveyed to the sixth conveying path 106, and is subjected to the folded sheet pressing process by the folded sheet pressing device 151. Subsequently, the sheet passes the sixth conveying path 106, is guided to the seventh conveying path 107 by the third switching claw 123, and then is guided to the ninth conveying path 109 by the fourth switching claw 124 so as to be stacked on the discharging unit 131. In the case where the sheet is discharged to the outside of the apparatus, the sheet is discharged to the outside of the apparatus while the conveying direction thereof is switched by the third switching claw 123.

Outward Three-Face Folding, Inward Three-Face Folding, and Simple Four-Face Folding The sheet is guided to the first conveying path 101 by the first switching claw 121. The front end of the sheet comes into contact with the first stopper 141 of the second conveying path 102. The flexure portion formed in the sheet is made to advance the nip between the first folding roller 111 and the second folding roller 112 so as to perform first folding thereon, and the sheet is conveyed to the third conveying path 103.

Figure 13C:
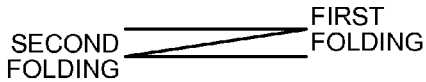
FIG. 13C is a diagram illustrating an outward three-face folding process of the embodiments.
Figure 13D:
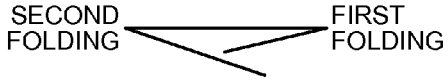
FIG. 13D is a diagram illustrating an inward three-face folding process of the embodiment.
Figure 13E:
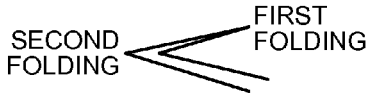
FIG. 13E is a diagram illustrating a simple four-face folding process of the embodiment.

The front end of the sheet comes into contact with the second stopper 142 of the third conveying path 103, and the flexure portion of the sheet is made to advance the nip between the second folding roller 112 and the third folding roller 113 so as to perform second folding. In this way, the folding is completed (FIGS. 13C, 13D, and 13E).

After the folding is completed, the sheet is guided to the fifth conveying path 105 by the second switching claw 122. Furthermore, the sheet is conveyed to the sixth conveying path 106, and is subjected to the folded sheet pressing process by the folded sheet pressing device 151. Subsequently, the sheet passes the sixth conveying path 106, and is guided to the seventh conveying path 107 by the third switching claw 123. Furthermore, the sheet is guided to the ninth conveying path 109 by the fourth switching claw 124 so as to be stacked on the discharging unit 131. In the case where the sheet is discharged to the outside of the apparatus, the sheet is discharged to the outside of the apparatus while the conveying direction thereof is switched by the third switching claw 123.

Side-by-Side Four-Face Folding

The sheet is guided to the first conveying path 101 by the first switching claw 121. The front end of the sheet comes into contact with the first stopper 141 of the second conveying path 102. The flexure portion formed in the sheet is made to advance to the nip between the first folding roller 111 and the second folding roller 112 so as to perform first folding, and the sheet is conveyed to the third conveying path 103.

The front end of the sheet comes into contact with the second stopper 142 of the third conveying path 103, and the flexure portion of the sheet is made to advance the nip between the second folding roller 112 and the third folding roller 113 so as to perform second folding. Subsequently, the sheet is conveyed to the fourth conveying path 104 by the second switching claw 122.

Figure 13F:
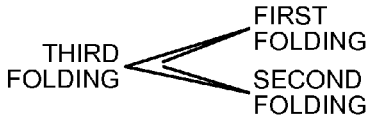
FIG. 13F is a diagram illustrating a side-by-side four-face folding process of the embodiments.

The front end of the sheet comes into contact with the third stopper 143 which has moved to a predetermined folding position of the fourth conveying path 104, and the flexure portion of the sheet is made to advance the nip between the fourth folding roller 114 and the fifth folding roller 115 so as to perform third folding. In this way, the side-by-side four-face folding is completed (FIG. 13F).

When the front end of the sheet comes into contact with the third stopper 143 of the fourth conveying path 104 and then the flexure portion of the sheet is made to advance to the nip between the fourth folding roller 114 and the fifth folding roller 115, a side-by-side four-face folding guide member (not illustrated) is operated, and the end of the involved sheet surely advances to the nip between the fourth folding roller 114 and the fifth folding roller 115.

After the folding is completed, the sheet is conveyed to the sixth conveying path 106, and is subjected to the folded sheet pressing process by the folded sheet pressing device 151. Then, the sheet passes the sixth conveying path 106, is guided to the seventh conveying path 107 by the third switching claw 123, and is guided to the ninth conveying path 109 by the fourth switching claw 124 so as to be stacked on the discharging unit 131. In the case where the sheet is discharged to the outside of the apparatus, the sheet is discharged to the outside of the apparatus while the conveying direction thereof is switched by the third switching claw 123.

Next, a first embodiment of the invention will be described.

Figure 2:
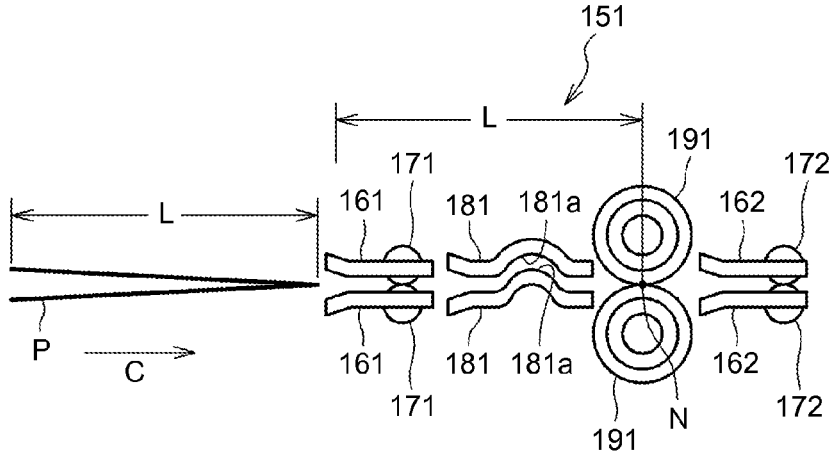
FIG. 2 is a diagram illustrating the schematic configuration of a folded sheet pressing device according to a first embodiment of the invention.

FIG. 2 is a diagram illustrating the schematic configuration of a folded sheet pressing device according to a first embodiment of the invention.

The folded sheet pressing device 151 illustrated in FIG. 2 includes a pair of folded sheet pressing rollers 191, a pair of upstream guide plates 161 which is disposed at the upstream of the pair of folded sheet pressing rollers 191 in the sheet conveying direction (the direction depicted by the arrow C of the drawing) so as to face each other, a pair of upstream carriage rollers 171 which is disposed therein, a pair of downstream guide plates 162 which is disposed in the downstream of the pair of folded sheet pressing rollers 191 in the sheet conveying direction so as to face each other, a pair of downstream carriage rollers 172 which is disposed therein, and two curved guide plates 181 which are disposed at the upstream of the pair of folded sheet pressing rollers 191 in the sheet conveying direction so as to face each other.

The pair of folded sheet pressing rollers 191 is a folded sheet pressing unit which enhances the folded edge of the sheet P subjected to the folding process. Specifically, when the sheet P advances between the pair of folded sheet pressing rollers 191, the sheet P is pressurized, so that the folded edge is enhanced. The upstream guide plates 161, the downstream guide plates 162, and the curved guide plates 181 are respectively guide members which guide the sheet P subjected to the folding process in the sheet conveying direction. When the pair of upstream carriage rollers 171, the pair of downstream carriage rollers 172, and the pair of folded sheet pressing rollers 191 serving as a conveying unit conveying the sheet are rotationally driven by a driving device (not illustrated), the sheet P is conveyed while passing between the respective guide plates 161, 181, and 162.

Further, the respective curved guide plates 181 serve as a curving unit which curves the sheet P in the sheet conveying direction. The respective curved guide plates 181 respectively include curved surfaces 181*a* which are curved in a circular-arc shape in the sheet conveying direction, where in the curved surfaces 181*a*, one of them is formed as a concave curved surface and the other thereof is formed as a convex curved surface, which forms a curved conveying path between the curved surfaces 181*a* facing each other. When the sheet P is guided along the respective curved guide plates 181 formed in this way, the sheet P is curved in the sheet conveying direction.

In FIG. 2, when the length of the sheet P subjected to the folding process in the sheet conveying direction is denoted by L, the respective curved surfaces 181*a* are disposed at a position, in upstream side of the sheet conveying direction, equal to or less than a length L in the sheet conveying direction of the sheet P subjected to the folding process from a position where the folded edge is enhanced by the pair of folded sheet pressing rollers 191, i.e., the position of the nip N of the pair of folded sheet pressing rollers 191. Since the respective curved surfaces 181*a* are disposed in such position, when the sheet P subjected to the folding process is supplied to the pair of folded sheet pressing rollers 191, the sheet P is present between the curved surfaces 181*a* and the sheet P may be supplied to the pair of folded sheet pressing rollers 191 in a curved state. Further, the curvature of each of the curved surfaces 181*a* is set to be equal to or less than a radius of a circle having a circumferential length equal to the length of the sheet P subjected to the folding process in the sheet conveying direction, that is, equal to or less than $L/2\pi$.

Referring to FIG. 2, an operation of the folded sheet pressing device according to the first embodiment of the invention will be described.

The sheet P, which is subjected to the folding process by the upstream folding member (the folding roller), is nipped and conveyed by the pair of rotating upstream carriage rollers 171, and the sheet P sequentially passes between the upstream guide plates 161 and the curved guide plates 181. When the sheet P passes between the curved guide plates 181, the sheet P is curved in the sheet conveying direction with a curvature of $L/2\pi$ or less along the curved guide plates 181. Then, while the sheet P is curved at the position of the curved guide plates 181, the front end of the sheet P advances between the pair of folded sheet pressing rollers 191. The sheet P, which advances between the pair of folded sheet pressing rollers 191, is nipped and conveyed by the pair of rotating folded sheet pressing rollers 191 and is pressurized so as to enhance the folded edge. The sheet P of which the folded edge is enhanced is conveyed to the downstream by the pair of folded sheet pressing rollers 191, is nipped and conveyed by the pair of rotating downstream carriage rollers 172, passes between the downstream guide plates 162, and then is discharged to the downstream discharging unit or the outside of the apparatus.

Figure 3A:
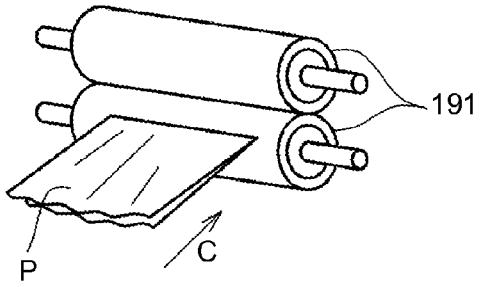
FIG. 3A is a diagram illustrating a sheet state where a sheet subjected to a folding process is supplied to a pair of folded sheet pressing rollers without being curved in the sheet conveying direction.
Figure 3B:
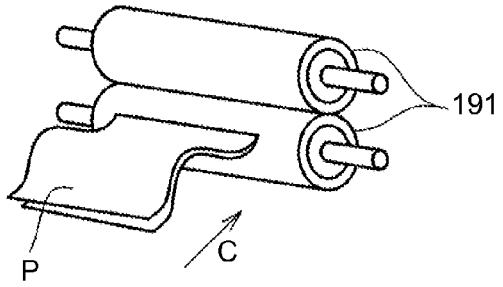
FIG. 3B is a diagram illustrating a sheet state where a sheet subjected to the folding process is supplied to the pair of folded sheet pressing rollers while being curved in the sheet conveying direction.

In FIGS. 3A and 3B, FIG. 3A is a diagram illustrating a sheet state where the sheet subjected to the folding process is supplied to the pair of folded sheet pressing rollers without being curved in the sheet conveying direction, and FIG. 3B is a diagram illustrating a sheet state where the sheet subjected to the folding process is supplied to the pair of folded sheet pressing rollers while being curved in the sheet conveying direction.

As illustrated in FIG. 3A, generally, the sheet P subjected to the folding process is conveyed so that the longitudinal direction thereof is parallel to the sheet conveying direction C. At this time, the manufacturing texture of the sheet P (the line direction of the fiber) is longitudinal, that is, the manufacturing texture is parallel to the sheet conveying direction C, buckling easily occurs in the width direction which is perpendicular to the sheet conveying direction C. For this reason, there is a tendency that the flexure easily occurs in the width direction of the sheet P. Then, as illustrated in FIG. 3A, when the sheet P advances between the pair of folded sheet pressing rollers 191 while the flexure occurs in the sheet P in the width direction, the flexure of the sheet P is crushed by the pair of folded sheet pressing rollers 191, so that it becomes a wrinkle.

On the contrary, as illustrated in FIG. 3B, when the sheet P subjected to the folding process is curved in the sheet conveying direction C, stronger stiffness is given to the sheet P in the width direction perpendicular to the sheet conveying direction C, so that a resistance against the buckling in the width direction increases. Accordingly, the occurrence of the flexure of the sheet P in the width direction which causes the wrinkle may be prevented. In this way, in the embodiment, since the sheet P may be supplied between the pair of folded sheet pressing rollers 191 without any flexure in the width direction by curving the sheet P in the sheet conveying direction using the curved guide plates 181, the occurrence of the wrinkle may be prevented.

Hereinafter, only differences between the first embodiment and the other embodiments of the invention will be described.

Figure 4:
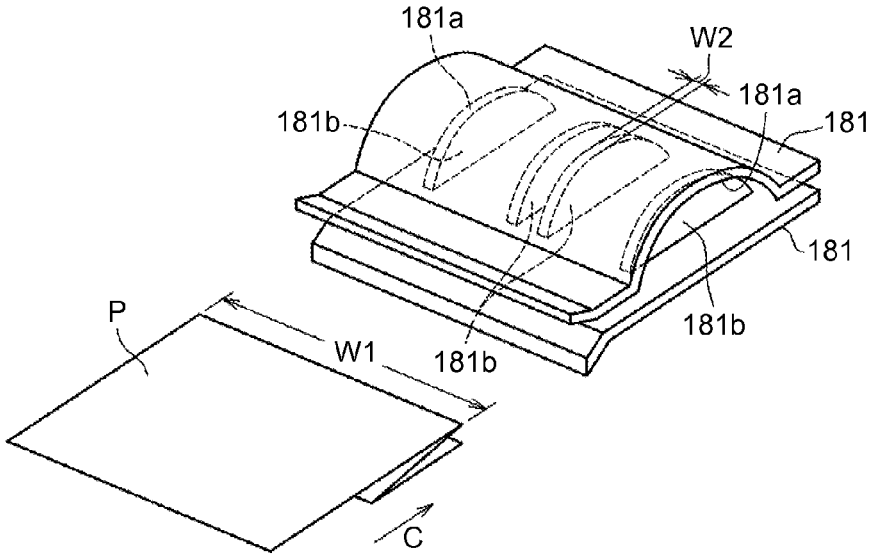
FIG. 4 is a perspective view illustrating a curved guide plate according to a second embodiment of the invention.

FIG. 4 is a perspective view illustrating the curved guide plate according to a second embodiment of the invention.

As illustrated in FIG. 4, the curved guide plate 181 which is at the upside of the drawing in the curved guide plates 181 according to the second embodiment includes the curved surface 181*a* throughout the entire area of the length, that is, the sheet width W1 in the direction perpendicular to the sheet conveying direction C of the sheet P subjected to the folding process. Meanwhile, the curved guide plate 181 which is at the downside of the drawing includes the curved surface 181*a* which corresponds to only a part of the sheet width W1. Specifically, the curved guide plate 181 which is at the downside of the drawing includes plural ribs 181*b* which are formed in a semi-circular shape, and the curved upper surface of each rib 181*b* is formed as the curved surface 181*a*. Further, it is desirable that the width W2 in the direction perpendicular to the sheet conveying direction C of the rib 181*b* (the curved surface 181*a*) be 0.5 mm or more.

In the embodiment, four ribs 181*b* are arranged, but the number of the ribs 181*b* is not limited. However, it is desirable to arrange the ribs 181*b* at least three positions, both end portions and the center portion of the sheet in the width direction. The reason why the ribs 181*b* are needed at three positions in total is as below. The ribs 181*b* provided at two positions support both end portions of the sheet in the width direction so as to maintain the shape thereof, and the rib 181*b* provided at one position supports the center portion of the sheet so as to prevent the center portion of the sheet in the width direction from being bent when both end portions of the sheet in the width direction are supported. Furthermore, since the flexure does not easily occur in the direction perpendicular to the width direction of the sheet in the comparatively small sheet such as A4, B5, and LT sizes compared to the comparatively large sheet such as A3 and DLT sizes, the number of the arrangement positions of the rib 181*b* may be set to be three or less. Further, by appropriately changing the range of arranging the rib 181*b* (the curved surface 181*a*) in accordance with the type of the folding process or the property of the sheet other than the size of the sheet, the function of preventing the wrinkle using the curved guide plate 181 may be optimized.

Further, in the curved guide plate 181 which is at the downside of the drawing, the other surface (the upper surface of the drawing) on which the rib 181*b* is arranged is formed as a flat surface and is formed so as not to come into contact with the passing sheet. Thus, when the sheet P passes between the respective curved guide plates 181, for the curved guide plate 181 at the downside of the drawing, the sheet P comes into contact with only the rib 181*b*. In this way, in the embodiment, since the curved guide plate 181 is provided with the ribs 181*b*, the occurrence of the wrinkle may be prevented by curving the passing sheet in the sheet conveying direction, the contact area between the sheet and the curved guide plates 181 may be reduced, and a conveying resistance which is not necessary for the sheet may be suppressed.

Furthermore, in the example illustrated in FIG. 4, the ribs 181*b* are arranged only at the curved guide plate 181 which is at the downside of the drawing. However, the curved guide plate 181 which is at the upside of the drawing may be provided with a rib having a concave curved surface. Further, a configuration may be adopted in which the curved guide plate 181 which is at the upside of the drawing is provided with the rib and the curved guide plate 181 which is at the downside of the drawing is provided with the curved surface 181*a* throughout the whole area of the sheet width W1.

Figure 5:
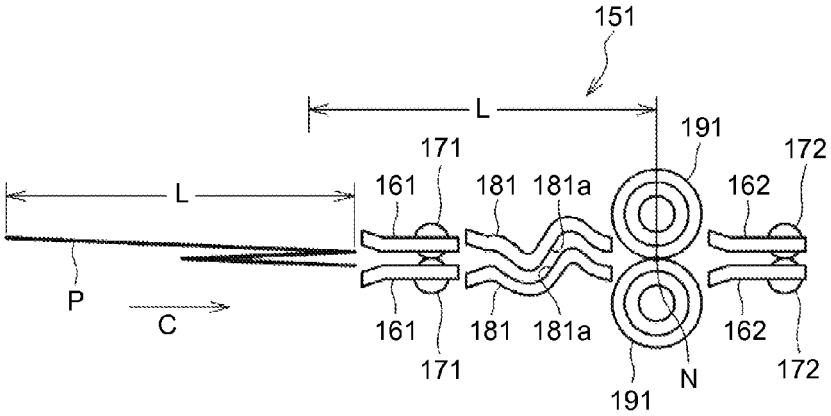
FIG. 5 is a diagram illustrating a schematic configuration of a folded sheet pressing device according to a third embodiment of the invention.

FIG. 5 is a diagram illustrating a schematic configuration of the folded sheet pressing device according to a third embodiment of the invention.

In the third embodiment illustrated in FIG. 5, the shape of the curved surface 181*a* of the curved guide plate 181 is different compared to the above-described embodiment illustrated in FIG. 2. Specifically, the curved surface 181*a* illustrated in FIG. 2 is formed in a circular-arc shape, but the curved surface 181*a* illustrated in FIG. 5 is formed in a substantially S-shape in which two circular-arc curved portions (hereinafter, referred to as a 'circular-arc curved portion') are continuously arranged in the sheet conveying direction C.

In this way, in the third embodiment illustrated in FIG. 5, two circular-arc curved portions are provided in the sheet conveying direction C. Accordingly, when the sheet P passes between the curved guide plates 181, the number of the curved positions of the sheet P increases and the stiffness given to the sheet P in the width direction becomes much stronger. As a result, since the resistance of the sheet P against the buckling in the width direction increases, the flexure of the sheet is more difficult to occur in the width direction, and the occurrence of the wrinkle may be further reliably prevented during the folded sheet pressing process.

Further, in the same way as described above, each curved surface 181*a* is disposed at a position, in upstream side of the sheet conveying direction, equal to or less than the length L in the sheet conveying direction of the sheet P subjected to the folding process from the position of the nip N of the pair of folded sheet pressing rollers 191. That is, two continuous circular-arc curved portions in the sheet conveying direction C are both disposed at a position, in upstream side of the sheet conveying direction, equal to or less than the length L in the sheet conveying direction of the sheet P subjected to the folding process from the position of the nip N of the pair of folded sheet pressing rollers 191. Accordingly, when the sheet P subjected to the folding process is supplied to the pair of folded sheet pressing rollers 191, the sheet P is present in the two continuous circular-arc curved portions, and the sheet P may be supplied to the pair of folded sheet pressing rollers 191 in a curved state.

Further, even in the third embodiment illustrated in FIG. 5, each curvature of the circular-arc curved portions may be set to $L/2\pi$ or less in the same way as described above. However, a large conveying resistance occurs in the sheet P when the sheet P having a comparatively large flexure in the sheet width direction passes between the curved surfaces having a small curvature. Accordingly, it is desirable that the upstream curvature of the sheet conveying direction be larger than the downstream curvature in the two circular-arc curved portions. In this way, the flexure of the sheet P may easily improve without generating a large conveying resistance in the upstream circular-arc portion having a large curvature, and the flexure may be completely corrected in the downstream circular-arc portion having a small curvature.

Furthermore, the number of the circular-arc curved portions arranged in the sheet conveying direction C may be three or more as long as the respective circular-arc curved portions are disposed at a position, in upstream side of the sheet conveying direction, equal to or less than the length L in the sheet conveying direction of the sheet P subjected to the folding process from the position of the nip N of the pair of folded sheet pressing rollers 191. In this case, the flexure may be made to be more difficult to occur in the sheet width direction.

Figure 6:
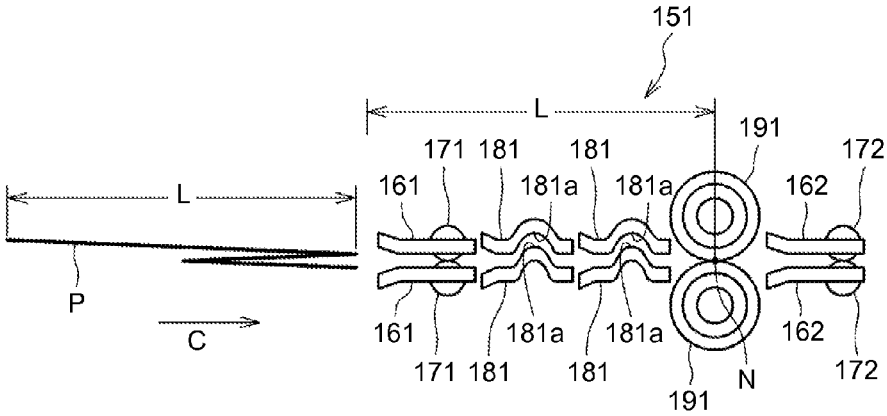
FIG. 6 is a diagram illustrating a schematic configuration of a folded sheet pressing device according to a fourth embodiment of the invention.

FIG. 6 is a diagram illustrating a schematic configuration of the folded sheet pressing device according to a fourth embodiment of the invention.

In the above described embodiment illustrated in FIG. 5, one curved guide plate is provided with two circular-arc curved portions. However, in the fourth embodiment illustrated in FIG. 6, two curved guide plates each having one circular-arc curved portion are arranged, so that two circular-arc curved portions are arranged in the sheet conveying direction C. Specifically, in the embodiment illustrated in FIG. 6, four curved guide plates 181 each having the circular-arc curved surface 181*a* are arranged so that each of two pairs thereof face each other and the two pairs are arranged in the sheet conveying direction C.

Also in this embodiment, since two or more circular-arc curved portions are arranged in the sheet conveying direction C as in the embodiment illustrated in FIG. 5, the number of curved positions of the sheet P increases, and the stiffness of the sheet P in the width direction becomes much stronger. For this reason, the flexure is more difficult to occur in the sheet width direction, and the occurrence of the wrinkle may be more reliably prevented during the folded sheet pressing process.

Further, in this case, all of the curved surfaces 181*a* included in the four curved guide plates 181 are arranged at a position, in upstream side of the sheet conveying direction, equal to or less than the length L in the sheet conveying direction of the sheet P subjected to the folding process from the position of the nip N of the pair of folded sheet pressing rollers 191. Accordingly, in the same way as described above, when the sheet P subjected to the folding process is supplied between the pair of folded sheet pressing rollers 191, the sheet P is present between the respective curved surfaces 181*a*, and the sheet P may be supplied between the pair of folded sheet pressing rollers 191 in a curved state.

Further, the curvature of each of the curved surfaces 181*a* may be $L/2\pi$ or less. However, it is desirable that the upstream curvature of the sheet conveying direction be set to be larger than the downstream curvature due to the same reason as that of the embodiment illustrated in FIG. 5.

Furthermore, the number of the curved guide plates arranged in the sheet conveying direction C may be three or more as long as the respective curved surfaces are arranged at a position, in upstream side of the sheet conveying direction, equal to or less than the length L in the sheet conveying direction of the sheet P subjected to the folding process from the position of the nip N of the pair of folded sheet pressing rollers 191. In this case, the flexure may be made to be more difficult to occur in the sheet width direction.

Figure 7:
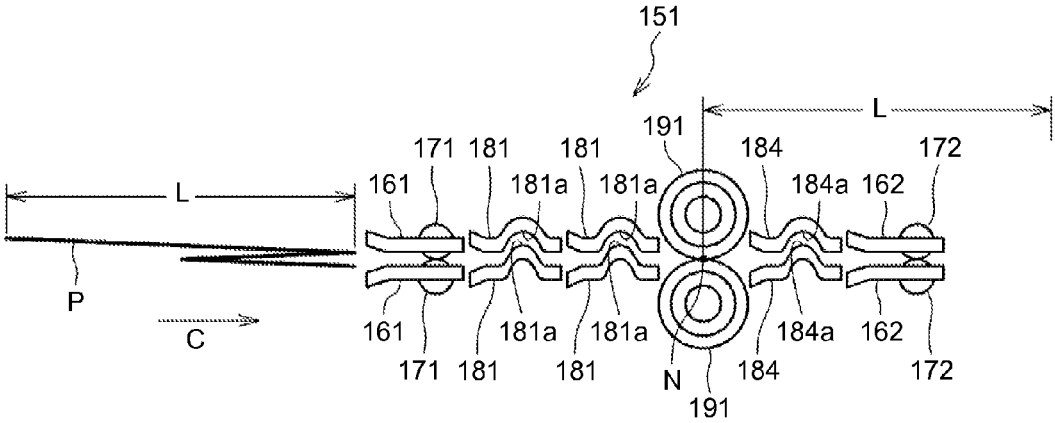
FIG. 7 is a diagram illustrating a schematic configuration of a folded sheet pressing device according to a fifth embodiment of the invention.

FIG. 7 is a diagram illustrating a schematic configuration of a folded sheet pressing device according to a fifth embodiment of the invention.

As illustrated in FIG. 7, in the fifth embodiment, the upstream configuration of the sheet conveying direction C from the pair of folded sheet pressing rollers 191 is the same as that of the embodiment illustrated in FIG. 6. Accordingly, in the same way as that of the embodiment illustrated in FIG. 6, the number of the curved positions of the sheet P increases and the flexure of the sheet width direction is more difficult to occur due to the two circular-arc curved portions arranged at the upstream of the pair of folded sheet pressing rollers 191 in the sheet conveying direction C, thereby more reliably preventing the occurrence of the wrinkle.

Furthermore, in the embodiment illustrated in FIG. 7, two curved guide plates 184 are separately provided at the downstream of the pair of folded sheet pressing rollers 191 in the sheet conveying direction C so as to face each other. For this reason, in the embodiment, after the front end of the sheet P passes the nip between the pair of folded sheet pressing rollers 191, the front end thereof is curved in the sheet conveying direction C at each curved surface 184*a* of the downstream curved guide plates 184.

When the front end of the sheet P passes the nip between the pair of folded sheet pressing rollers 191, the front end thereof becomes a free end until it reaches the next pair of downstream carriage rollers 172. At this time, since the front end of the sheet P undergoes air resistance or other conveying resistances, when the flexure occurs at the front end of the sheet P in the sheet width direction, the flexure may be transmitted to the rear end of the sheet P, which has a high possibility that it may become a wrinkle. However, in the embodiment, since the front end of the sheet P is curved in the sheet conveying direction C by the downstream curved guide plate 184 as described above, the occurrence of the flexure may be prevented at the front end of the sheet P in the sheet width direction, thereby preventing the occurrence of the wrinkle which is caused by the flexure transmitted from the front end to the rear end.

Further, the curvature of each curved surface 184*a* of the downstream curved guide plates 184 may be $L/2\pi$ or less as in the curvature of the upstream curved surface 181*a*. Further, the respective downstream curved surfaces 184*a* are arranged at a position, in downstream side of the sheet conveying direction, equal to or less than the length L in the sheet conveying direction of the sheet P subjected to the folding process from the position of the nip N of the pair of folded sheet pressing rollers 191. Accordingly, since the front end of the sheet P is curved by the downstream curved guide plate 184 while the rear end of the sheet P passes the nip between the pair of folded sheet pressing rollers 191, the occurrence of the wrinkle at the rear end of the sheet due to the flexure at the front end of the sheet P may be prevented.

Figure 8:
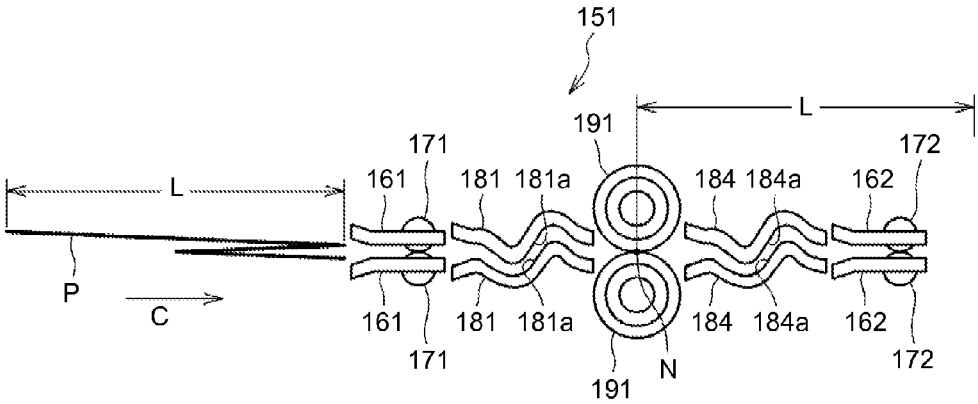
FIG. 8 is a diagram illustrating a schematic configuration of a folded sheet pressing device according to a sixth embodiment of the invention.

FIG. 8 is a diagram illustrating a schematic configuration of a folded sheet pressing device according to a sixth embodiment of the invention.

In the sixth embodiment illustrated in FIG. 8, the respective curved surfaces 184*a* of the downstream curved guide plates 184 are formed substantially S-shaped in which two circular-arc curved portions are continuously arranged in the sheet conveying direction C. That is, in this case, the number of the circular-arc curved portions increases so as to be twice that of the embodiment illustrated in FIG. 7. Accordingly, since the number of curved positions near the front end of the sheet P increases and the stiffness of the sheet P in the width direction becomes much stronger, the flexure in the sheet width direction is more difficult to occur and the occurrence of the wrinkle may be more reliably prevented during the folded sheet pressing process.

The curvature of each circular-arc curved portion included in the downstream curved guide plate 184 may be $L/2\pi$ or less as described above. Further, all the respective downstream circular-arc curved portions are arranged at a position, in downstream side of the sheet conveying direction, equal to or less than the length L in the sheet conveying direction of the sheet P subjected to the folding process from the position of the nip N of the pair of folded sheet pressing rollers 191. Accordingly, since the front end of the sheet P is curved by the respective downstream circular-arc curved portions while the rear end side of the sheet P passes the nip between the pair of folded sheet pressing rollers 191, the occurrence of the wrinkle at the rear end side due to the flexure at the front end of the sheet P may be prevented.

Further, the number of the downstream circular-arc curved portions may be three or more as long as the respective circular-arc curved portions are arranged at a position, in downstream side of the sheet conveying direction, equal to or less than the length L in the sheet conveying direction of the sheet P subjected to the folding process from the position of the nip N of the pair of folded sheet pressing rollers 191. In this case, the flexure may be made to be more difficult to occur in the sheet width direction.

Further, although not illustrated in the drawings, a configuration may be adopted in which two or more circular-arc curved portions are arranged in the sheet conveying direction C by arranging two or more curved guide plates at the downstream of the pair of folded sheet pressing rollers 191 in the sheet conveying direction C. Further, in this case, all of the circular-arc curved portions (or the respective curved surfaces) of the curved guide plates arranged at the downstream may be arranged with a curvature of $L/2\pi$ or less, and they may be arranged at a position, in downstream side of the sheet conveying direction, equal to or less than the length L in the sheet conveying direction of the sheet P subjected to the folding process from the position of the nip N of the pair of folded sheet pressing rollers 191.

Furthermore, in the embodiment illustrated in FIG. 8, since the other configurations are the same as those of the embodiment illustrated in FIG. 5, the configuration, the operation, and the effect thereof will not be repeated.

Figure 9:
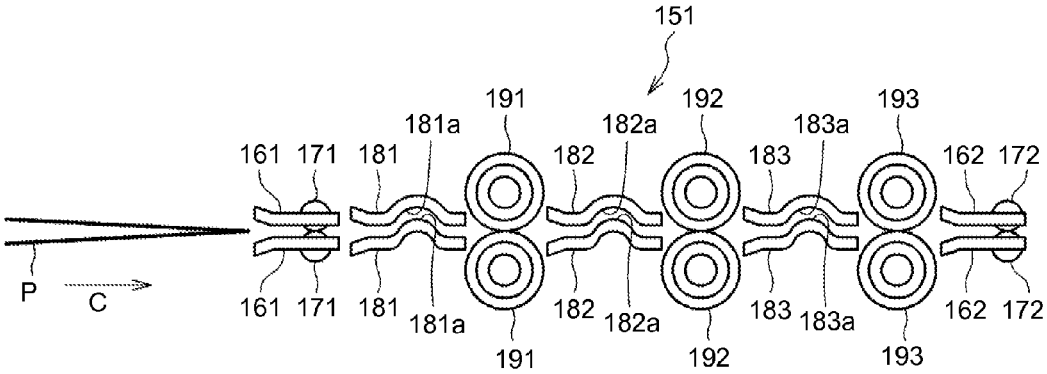
FIG. 9 is a diagram illustrating a schematic configuration of a folded sheet pressing device according to a seventh embodiment of the invention.

FIG. 9 is a diagram illustrating a schematic configuration of a folded sheet pressing device according to a seventh embodiment of the invention.

The folded sheet pressing device 151 illustrated in FIG. 9 includes three pairs of folded sheet pressing rollers 191, 192, and 193. Accordingly, the sheet P is pressurized whenever passing between the respective pairs of folded sheet pressing rollers 191, 192, and 193, so that the folded edge is more reliably enhanced. Further, the curved guide plates 181, 182, and 183 are arranged at the upstream of the respective pairs of folded sheet pressing rollers 191, 192, and 193 in the sheet conveying direction C and the guide plates of each pair of the curved guide plates 181, 182, and 183 face each other, and the sheet P is supplied to the respective pairs of folded sheet pressing rollers 191, 192, and 193 in a curved state in the sheet conveying direction C. Accordingly, the occurrence of the wrinkle during the respective folded sheet pressing processes may be prevented. The respective curved guide plates 182 (183) respectively include curved surfaces 182*a* (183*a*) which are curved in a circular-arc shape in the sheet conveying direction, where in the curved surfaces 182*a* (183*a*), one of them is formed as a concave curved surface and the other thereof is formed as a convex curved surface, which forms a curved conveying path between the curved surfaces 182*a* (183*a*) facing each other. The curved guide plates 182 (183) are respectively guide members which guide the sheet P subjected to the folding process in the sheet conveying direction. Further, the respective curved guide plates 182 (183) serve as a curving unit which curves the sheet P in the sheet conveying direction.

Further, the curved guide plates 182 and 183 which are arranged at the second and third positions from the upstream of the sheet conveying direction C serve as the curved guide plates arranged at the downstream with respect to the pair of folded sheet pressing rollers 191 and 192 which are arranged at the first and second positions from the upstream. That is, since the front end of the sheet P which passes between the first pair of folded sheet pressing rollers 191 from the upstream is curved by the second curved guide plates 182 from the upstream, the occurrence of the flexure at the front end of the sheet P in the sheet width direction may be prevented. In the same way, since the front end of the sheet P which passes between the second pair of folded sheet pressing rollers 192 from the upstream is curved by the third curved guide plates 183 from the upstream, the occurrence of the flexure at the front end of the sheet P in the sheet width direction may be prevented. Accordingly, the occurrence of the wrinkle may be highly prevented.

Referring to FIGS. 10A to 12B, the configuration of the eighth embodiment of the invention will be described.

Figure 10A:
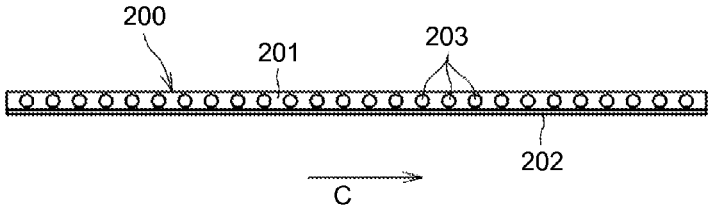
FIG. 10A is a side view illustrating a curved guide member according to an eighth embodiment of the invention, illustrating a state where the curved guide member is not curved.
Figure 10B:
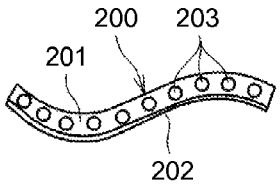
FIG. 10B is a side view illustrating the curved guide member according to the eighth embodiment of the invention, illustrating a state where the curved guide member is curved.

FIGS. 10A and 10B are side views illustrating a curved guide member which guides the sheet while being curved in the sheet conveying direction.

As illustrated in FIG. 10A, a curved guide member 200 is formed of a base material 201 which has plural holes 203 arranged in the sheet conveying direction C and a conveying surface material 202 which is disposed on the sheet conveying surface side of the base material 201. The base material 201 is formed of a deformable flexible member. For this reason, as illustrated in FIG. 10B, the curved guide member 200 may be easily and freely deformable. As the material of the base material 201, urethane or the like may be used. Further, the plural holes 203 arranged in the base material 201 are respectively arranged with the same size and the same pitch. As the conveying surface material 202, a material such as polyethylene terephthalate having a comparatively small friction coefficient may be used.

Figure 11A:
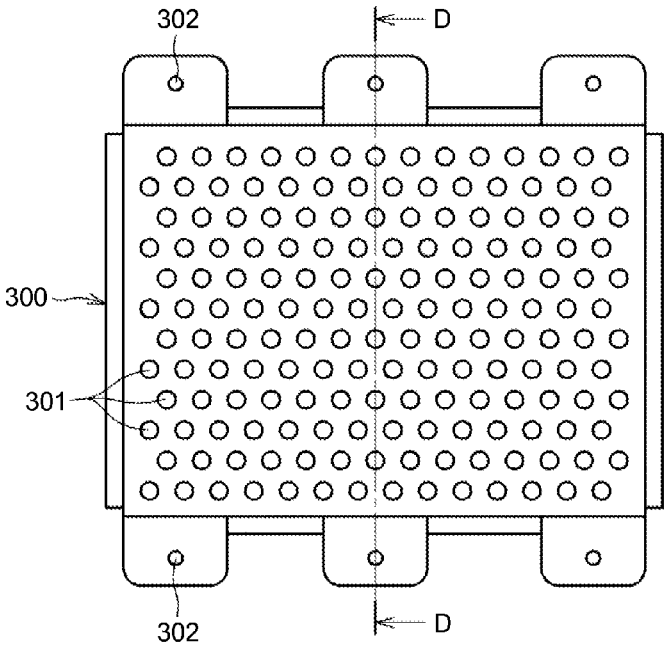
FIG. 11A is a diagram illustrating a configuration of a support member according to the eighth embodiment of the invention, illustrating a side view.
Figure 11B:
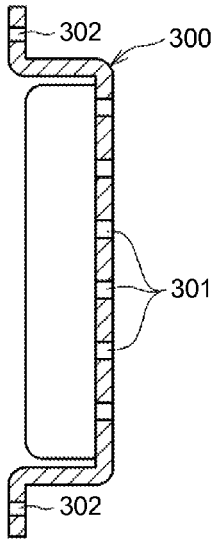
FIG. 11B is the diagrams illustrating the configuration of the support member according to the eighth embodiment of the invention, illustrating a cross-sectional view taken along the line D-D of FIG. 11A.

FIGS. 11A and 11B are diagrams illustrating a configuration of a support member which supports the curved guide member, and FIG. 11B is a cross-sectional view taken along the line D-D of FIG. 11A.

As illustrated in FIGS. 11A and 11B, a support member 300 includes screw holes 302 which are respectively provided at the upper and lower ends of the drawing so as to be threaded into a side plate (not illustrated) of the sheet processing apparatus and plural (or multiple) holes 301 which are used for the attachment of a support shaft supporting the curved guide member 200. The support member 300 may be formed of metal such as stainless having high strength and sufficient strength through a bending process or the like.

Figure 12A:
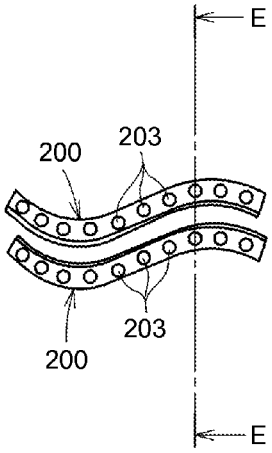
FIG. 12A is a diagram illustrating a state where the curved guide member according to the eighth embodiment of the invention is supported by the support member, illustrating a side view.
Figure 12B:
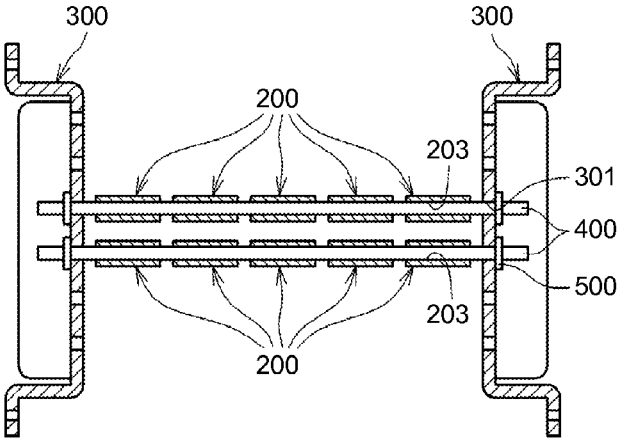
FIG. 12B is the diagram illustrating the state where the curved guide member according to the eighth embodiment of the invention is supported by the support member, illustrating a cross-sectional view taken along the line E-E of FIG. 12A.

FIGS. 12A and 12B are diagrams illustrating a state where the curved guide member is supported by the support member, and FIG. 12B is a cross-sectional view taken along the line E-E of FIG. 12A. In other words, FIG. 12A is a diagram illustrating a configuration of the embodiment when seen from the lateral direction perpendicular to the sheet conveying direction, and FIG. 12B is a diagram illustrating the configuration when seen from the sheet conveying direction. Furthermore, in FIG. 12A, only the curved guide member is illustrated.

As illustrated in FIG. 12B, plural curved guide members 200 are supported through support shafts 400 between the pair of support members 300. Specifically, the support shafts 400 are inserted through the respective holes 203 of the plural curved guide members 200 arranged in the sheet width direction (the lateral direction of FIG. 12B), and both end portions of the support shafts 400 are attached by being inserted through the holes 301 of the pair of support members 300. Furthermore, both end portions of the support shafts 400 are fixed to the respective support members 300 by separation preventing members 500. Further, the respective support members 300 are fixed to the side plate (not illustrated) of the sheet processing apparatus by inserting a screw into the screw hole 302 (see FIGS. 11A and 11B).

As illustrated in FIG. 12A, the curved guide members 200 may be supported in a curved state by selecting the hole 301 through which the support shaft 400 is inserted among the plural holes 301 when both end portions of the support shafts 400 are inserted through the holes 301 of the support members 300. When the curved guide members 200 supported in a curved state in this way are disposed between the support members 300 so as to face each other, a curved guide path which guides the sheet is formed. Then, when the guide path formed by the curved guide member 200 is disposed at a predetermined position of the upstream or the downstream of the pair of folded sheet pressing rollers in the sheet conveying direction, as described above, the occurrence of the wrinkle of the sheet during the folded sheet pressing process may be prevented.

Furthermore, in the embodiment, since the curved guide member 200 is deformable and the support shaft 400 may be attached to the hole 301 arbitrarily selected among the plural holes 301 of the support member 300, the curvature of the curved guide member 200 may be changed by changing the attachment position of the support shaft 400. Accordingly, the curved degree of the sheet may be optimally adjusted depending on the property of the sheet or the type of the folding process.

Further, the gap between the curved guide members 200 facing each other may be changed by changing the attachment position of the support shaft 400. Accordingly, the gap in the direction perpendicular to the sheet surface in the guide path may be optimally adjusted depending on the thickness or the like of various sheets, and an unnecessary conveying resistance occurring in the sheet may be suppressed.

Furthermore, the support shaft 400 does not need to be inserted through all holes 203 of the curved guide member 200. The number of the support shafts 400 inserted through the holes 203 may be freely set as long as the curved guide member 200 may maintain the shape of the guide path even by the conveying of the sheet.

As described above, according to the embodiments of the invention, since there is no need to temporarily stop the sheet so as to prevent the occurrence of the wrinkle during the folded sheet pressing process, the folded sheet pressing process may be performed without the occurrence of the wrinkle in the sheet while a degradation of the productivity is prevented. Accordingly, a folded sheet pressing device which has high quality and excellent productivity, a sheet processing apparatus which includes the same, and an image forming apparatus may be provided.

Since the stiffness of the sheet in the width direction perpendicular to the sheet conveying direction is increased by curving the sheet in the sheet conveying direction using the curving unit, the resistance against the buckling in the width direction increases. Accordingly, the occurrence of the flexure of the sheet in the width direction which may results in the wrinkles is prevented. In this way, since it is possible to supply the sheet to the folded sheet pressing unit without causing the flexure of the sheet in the width direction by curving the sheet in the sheet conveying direction, and hence to prevent generation of the wrinkles.

The sheet in the sheet conveying direction may be curved in a manner of passing between the guide members having the curved surfaces curved in the conveying direction of the sheet. Accordingly, it is possible to supply the sheet to the folded sheet pressing unit without the flexure in the width direction, thereby preventing the sheet from having wrinkle.

Since the curved surfaces are provided at the above described position, the sheet is allowed to be present between the curved surfaces when the sheet is supplied to the folded sheet pressing unit. Accordingly, the sheet can be supplied to the folded sheet pressing unit in a curved state.

In this way, since the curvature of the curved surfaces is set to the above described value, the sheet is enabled to curve in the sheet conveying direction while passing between the curved surfaces. This prevents generation of wrinkles in the sheet.

The action of preventing wrinkles may be optimized by providing the curved surface so as to correspond to the whole or part of the sheet width perpendicular to the sheet conveying direction in accordance with the size of the sheet, the property of the sheet, the type of the folding process, and the like.

Accordingly, every when the sheet passes between the curved surfaces, the number of the curved positions of the sheet is incremented, and the stiffness of the sheet in the width direction becomes stronger. As a result, the resistance against the buckling of the sheet in the width direction increases, and thus the flexure of the sheet in the sheet width direction is more difficult to occur, and the occurrence of the wrinkle may be more reliably prevented during the folded sheet pressing process.

In this case, every when the sheet passes between the curved surfaces, the number of the curved positions of the sheet is incremented and as a result the stiffness of the sheet in the width direction becomes stronger. Accordingly, since the resistance against the buckling of the sheet in the width direction increases in the way described above, the flexure of the sheet in the sheet width direction is more difficult to occur, and the occurrence of the wrinkle may be more reliably prevented during the folded sheet pressing process.

In this case, as described above, the sheet may be curved in the sheet conveying direction by the curved surfaces of the upstream guide members, and the sheet may be supplied to the folded sheet pressing unit without the flexure in the width direction. However, subsequently, the front end of the sheet which has passed through the folded sheet pressing unit becomes a free end. For this reason, the front end of the sheet experiences an air resistance or other conveying resistances at this time. For this reason, there is a high possibility that the flexure may be transmitted to the rear end side of the sheet, thereby forming a wrinkle when the flexure occurs at the front end of the sheet in the sheet width direction. Thus, the guide member having the curved surfaces is additionally provided on the downstream side of the folded sheet pressing unit in the sheet conveying direction. With this configuration, the front end of the sheet which has passed through the folded sheet pressing unit may be curved in the sheet conveying direction by the curved surfaces of the downstream guide member, which prevents the occurrence of the flexure at the front end of the sheet in the sheet width direction. In this way, the wrinkle caused due to the flexure of the front end transmitted to the rear end may be prevented from being generated.

Further, since the upstream curved surface is disposed at a position located, in upstream side of the sheet conveying direction, equal to or less than a length in the sheet conveying direction of the sheet subjected to the folding process from a position where the folded edge is enhanced by the folded sheet pressing unit as described above, the sheet may be supplied to the folded sheet pressing unit in a curved state as described above. Further, since the downstream curved surface is disposed at a position located, in downstream side of the sheet conveying direction, equal to or less than a length in the sheet conveying direction of the sheet subjected to the folding process from a position where the folded edge is enhanced by the folded sheet pressing unit, the front end of the sheet may be curved by the downstream curved surface while the rear end side of the sheet is passing the folded sheet pressing unit. Accordingly, the occurrence of the wrinkle at the rear end side caused by the flexure at the front end of the sheet may be prevented.

Accordingly, the curved degree of the sheet may be optimally adjusted by changing the curvature of the curved surface in accordance with the properties of various sheets, the type of the folding process, or the like.

Accordingly, the gap between the facing guide members may be optimally adjusted in accordance with the thickness or the like of various sheets, and an unnecessary conveying resistance occurring in the sheet may be suppressed.

As described above, the guide member may be supported in a manner such that the support shafts are inserted through the holes of the guide member and both end portions of the support shafts are inserted through the holes of the support members so as to be attached thereto. Furthermore, the curvature of the guide member or the gap between the guide members may be changed easily by deforming the guide member in a manner arbitrarily selecting the holes of the support members to which the support shaft is attached.

Since the sheet processing apparatus includes the above-described folded sheet pressing device, the above-described effect of the folded sheet pressing device may be obtained.

Accordingly, the folded edge of the sheet may be more reliably enhanced.

Since the image forming apparatus includes the above-described sheet processing apparatus, the above-described effect of the folded sheet pressing device included in the sheet processing apparatus is obtained.

According to the embodiments, since there is no need to temporarily stop the sheet in order to prevent the occurrence of the wrinkle during the folded sheet pressing process, the folded sheet pressing process may be performed without degrading the sheet folding productivity and generating the wrinkles in the sheet. Accordingly, it is possible to provide a folded sheet pressing device which has high quality and good productivity, and a sheet processing apparatus and an image forming apparatus which include the folded sheet pressing device.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A folded sheet pressing device, comprising:

a folded sheet pressing unit configured to enhance a folded edge of a sheet subjected to a folding process;

a pair of upstream guide plates which is disposed at an upstream of the folded sheet pressing unit in a sheet conveyance direction;

a pair of downstream guide plates which is disposed in a downstream of the folded sheet pressing unit in the sheet conveyance direction; and a curving unit configured to curve the sheet in a sheet conveying direction when the sheet is supplied to the folded sheet pressing unit, wherein each of the pair of the upstream and downstream guide plates and the curving unit are aligned in the same horizontal plane which corresponds to the sheet conveying direction, wherein the curving unit is configured with guide members that are disposed so as to face each other and have curved surfaces that curve the sheet in the sheet conveying direction, and the sheet is configured to pass between the guide members that face each other, wherein at least one of the guide members is formed with a flexible member that has a plurality of holes arranged in the sheet conveying direction and is deformable, the folded sheet pressing device further including:

a plurality of support shafts configured to be inserted through the holes of the guide member, and a pair of support members having a plurality of holes configured to retain both end portions of the support shafts inserted through the holes of the guide member, wherein the both end portions of the support shafts are configured to be retained in a hole arbitrarily selected from the plurality of holes of the support members.

2. The folded sheet pressing device according to claim 1, wherein the curved surfaces, disposed in upstream side of the sheet conveying direction, corresponds to a distance which is equal to or less than a length in the sheet conveying direction of the sheet subjected to the folding process from a position where the folded edge is enhanced by the folded sheet pressing unit.

3. The folded sheet pressing device according to claim 1, wherein a curvature of the curved surface is set to be equal to or less than a radius of a circle having a circumferential length equal to a length in the sheet conveying direction of the sheet subjected to the folding process.

4. The folded sheet pressing device according to claim 1, wherein the curved surfaces are arranged so as to correspond to an entire length or a partial length of a sheet width perpendicular to the sheet conveying direction.

5. The folded sheet pressing device according to claim 1, wherein the curved surfaces are formed so as to have a plurality of circular-arc curved portions in the sheet conveying direction.

6. The folded sheet pressing device according to claim 1, wherein a plurality of the guide members having the curved surfaces are arranged in the sheet conveying direction.

7. The folded sheet pressing device according to claim 1, wherein the guide members having the curved surfaces are arranged at both upstream side and downstream side of the folded sheet pressing unit in the sheet conveying direction, and each of the curved surfaces, disposed in upstream side or downstream side of the sheet conveying direction, corresponds to a distance which is equal to or less than a length in the sheet conveying direction of the sheet subjected to the folding process from a position where the folded edge is enhanced by the folded sheet pressing unit.

8. The folded sheet pressing device according to claim 1, wherein the curved surface is adjustable to have different curvature radii.

9. The folded sheet pressing device according to claim 1, wherein the facing guide members are adjustable to have different gap sizes.

10. The folded sheet pressing device according to claim 1, wherein a gap is provided between the pair of the upstream guide plates, the pair of downstream guide plates, the folded sheet pressing unit, and the curving unit in the sheet conveyance direction.

11. The folded sheet pressing device according to claim 1, wherein the curving unit includes respective curved guide plates which are curved in a circular-arc shape in the sheet conveyance direction.

12. The folded sheet pressing device according to claim 11, wherein the curved guide plates includes curved surfaces, wherein one of the curved surfaces is formed as a concave surface and the other thereof is formed as a convex curved surface, which forms a curved conveying path between the curved surfaces facing each other.

13. A sheet processing apparatus, comprising:

a folded sheet pressing device including;

a folded sheet pressing unit configured to enhance a folded edge of a sheet subjected to a folding process;

a pair of upstream guide plates which is disposed at an upstream of the folded sheet pressing unit in a sheet conveyance direction;

a pair of downstream guide plates which is disposed in a downstream of the folded sheet pressing unit in the sheet conveyance direction; and a curving unit configured to curve the sheet in a sheet conveying direction when the sheet is supplied to the folded sheet pressing unit, wherein each of the pair of the upstream and downstream guide plates and the curving unit are aligned in the same horizontal plane which corresponds to the sheet conveying direction, wherein the curving unit is configured with guide members that are disposed so as to face each other and have curved surfaces that curve the sheet in the sheet conveying direction, and the sheet is configured to pass between the guide members that face each other, wherein at least one of the guide members is formed with a flexible member that has a plurality of holes arranged in the sheet conveying direction and is deformable, the folded sheet pressing device further including:

a plurality of support shafts configured to be inserted through the holes of the guide member, and a pair of support members having a plurality of holes configured to retain both end portions of the support shafts inserted through the holes of the guide member, wherein the both end portions of the support shafts are configured to be retained in a hole arbitrarily selected from the plurality of holes of the support members.

14. The sheet processing apparatus according to claim 13, wherein a plurality of the folded sheet pressing units are arranged in the sheet conveying direction.

15. An image forming apparatus, comprising:

a sheet processing apparatus including a folded sheet pressing device, the folded sheet pressing device including;

a folded sheet pressing unit configured to enhance a folded edge of a sheet subjected to a folding process;

a pair of upstream guide plates which is disposed at an upstream of the folded sheet pressing unit in a sheet conveyance direction;

a pair of downstream guide plates which is disposed in a downstream of the folded sheet pressing unit in the sheet conveyance direction; and a curving unit configured to curve the sheet in a sheet conveying direction when the sheet is supplied to the folded sheet pressing unit, wherein each of the pair of the upstream and downstream guide plates and the curving unit are aligned in the same horizontal plane which corresponds to the sheet conveying direction, wherein the curving unit is configured with guide members that are disposed so as to face each other and have curved surfaces that curve the sheet in the sheet conveying direction, and the sheet is configured to pass between the guide members that face each other, wherein at least one of the guide members is formed with a flexible member that has a plurality of holes arranged in the sheet conveying direction and is deformable, and the folded sheet pressing device further including:

a plurality of support shafts configured to be inserted through the holes of the guide member, and a pair of support members having a plurality of holes configured to retain both end portions of the support shafts inserted through the holes of the guide member, wherein the both end portions of the support shafts are configured to be retained in a hole arbitrarily selected from the plurality of holes of the support members.

* * * * *